US011298842B2

(12) United States Patent
Hurtado et al.

(10) Patent No.: US 11,298,842 B2
(45) Date of Patent: Apr. 12, 2022

(54) RAZOR STRUCTURE

(71) Applicant: The Gillette Company LLC, Boston, MA (US)

(72) Inventors: Armando Miguel Hurtado, Boston, MA (US); Jahdiel Fyfield, Roslindale, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/122,127

(22) Filed: Sep. 5, 2018

(65) Prior Publication Data

US 2020/0070375 A1 Mar. 5, 2020

(51) Int. Cl.
*B26B 21/52* (2006.01)
*B25G 3/38* (2006.01)
*B26B 21/22* (2006.01)

(52) U.S. Cl.
CPC ..... *B26B 21/521* (2013.01); *B25G 3/38* (2013.01); *B26B 21/225* (2013.01)

(58) Field of Classification Search
CPC ..... B26B 21/225; B26B 21/52; B26B 21/521; B25G 3/38
USPC ..... 30/47–51, 526–533
See application file for complete search history.

(56) References Cited

U.S. PATENT DOCUMENTS 3,935,639 A * 2/1976 Terry ..... B26B 21/225 30/47
3,939,560 A 2/1976 Lyall
3,950,849 A 4/1976 Perry
4,094,063 A * 6/1978 Trotta ..... B26B 21/521 30/47
4,146,958 A 4/1979 Chen et al.
4,198,746 A * 4/1980 Trotta ..... B26B 21/225 30/47
4,266,340 A * 5/1981 Bowman ..... B26B 21/225 30/47
RE30,913 E 4/1982 Cartwright et al.
4,392,303 A * 7/1983 Ciaffone ..... B26B 21/521 30/526
4,514,904 A * 5/1985 Bond ..... B26B 21/225 30/47
4,599,793 A * 7/1986 Iten ..... B26B 21/225 30/47
4,756,082 A 7/1988 Apprille, Jr.
(Continued)

FOREIGN PATENT DOCUMENTS

WO 2010065366 A1 6/2010

OTHER PUBLICATIONS

International Search Report and Written Opinion; Application Ser. No. PCT/US2019/048532; dated Nov. 12, 2019, 10 pages.

*Primary Examiner* — Jason Daniel Prone
(74) *Attorney, Agent, or Firm* — Joanne N. Pappas; Kevin C. Johnson

(57) ABSTRACT

A razor handle including a main body and a head at one end of the main body. The head may include one or more inner bearing surfaces for pivotally engaging with a razor cartridge and one or more protrusions disposed on the one or more inner bearing surfaces. Also provided is a razor system including the razor handle and a razor cartridge pivotally coupled to the razor handle. The razor cartridge engages the one or more protrusions to limit pivotal movement of the razor cartridge with respect to the head.

18 Claims, 8 Drawing Sheets

(56) References Cited

U.S. PATENT DOCUMENTS 4,785,534 A * 11/1988 Lazarchik ..... B26B 21/225 30/50
4,854,043 A 8/1989 Chen
4,976,028 A 12/1990 Chen
5,003,694 A 4/1991 Chen
5,031,316 A 7/1991 Oldroyd
5,157,834 A * 10/1992 Chen ..... B26B 21/225 30/47
5,333,383 A * 8/1994 Ferraro ..... B26B 21/225 30/50
5,347,717 A * 9/1994 Ts'ai ..... B26B 21/225 30/50
5,386,750 A 2/1995 Morrison
5,412,872 A 5/1995 Iderosa
5,475,923 A 12/1995 Ferraro
5,501,014 A 3/1996 Hegemann
5,802,721 A 9/1998 Wain et al.
D402,084 S 12/1998 Ortiz et al.
5,953,819 A 9/1999 Simms et al.
6,035,535 A 3/2000 Dischler
6,112,412 A * 9/2000 Richard ..... B26B 21/443 30/50
6,167,625 B1 1/2001 King
6,298,557 B1 10/2001 Gilder
6,311,400 B1 * 11/2001 Hawes ..... B26B 21/225 30/50
6,421,925 B1 * 7/2002 Wonderley ..... B26B 21/4062 30/532
D467,387 S 12/2002 Wonderley
6,516,518 B1 2/2003 Garraway et al.
6,675,479 B1 1/2004 Walker, Jr. et al.
6,854,188 B1 * 2/2005 Wonderley ..... B26B 21/225 30/527
6,880,253 B1 * 4/2005 Gyllerstrom ..... B26B 21/14 30/50
6,941,659 B2 9/2005 Gilder
7,140,116 B2 * 11/2006 Coffin ..... B26B 21/225 30/531
7,152,512 B1 * 12/2006 Prochaska ..... B26B 21/225 30/527
7,200,942 B2 * 4/2007 Richard ..... B26B 21/225 30/526
7,331,107 B2 * 2/2008 Follo ..... B26B 21/521 30/50
7,461,458 B2 * 12/2008 Peyser ..... B26B 21/225 30/532
7,526,869 B2 * 5/2009 Blatter ..... B26B 21/225 30/532
7,574,809 B2 * 8/2009 Follo ..... B26B 21/225 30/527
D608,501 S 1/2010 Wain
D625,049 S 10/2010 Bridges et al.
D630,797 S 1/2011 Witkus
7,874,076 B2 * 1/2011 Gratsias ..... B26B 21/522 30/526
D633,254 S 2/2011 Witkus
D636,532 S 4/2011 Jessemey et al.
8,033,023 B2 * 10/2011 Johnson ..... B26B 21/225 30/50
D653,395 S 1/2012 Adams et al.
8,151,472 B2 4/2012 Dimitris et al.
D658,809 S 5/2012 Jessemey et al.
8,186,062 B2 5/2012 Fischer et al.
D665,948 S 8/2012 Jessemey et al.
8,359,751 B2 * 1/2013 Efthimiadis ..... B26B 21/222 30/50
8,359,752 B2 1/2013 Bridges
8,413,334 B2 4/2013 Walker, Jr. et al.
8,590,162 B2 * 11/2013 Park ..... B26B 21/225 30/50
D699,892 S 2/2014 Wonderley
8,726,518 B2 5/2014 Bruno
8,844,145 B2 * 9/2014 Psimadas ..... B26B 21/225 30/526
9,221,185 B2 12/2015 Walker, Jr. et al.
9,492,933 B2 11/2016 Wain et al.
D776,875 S 1/2017 Ren et al.
9,694,503 B2 * 7/2017 Papadopoulos-Papageorgis ..... B26B 21/222
D829,380 S 9/2018 Kong
D843,058 S * 3/2019 Fyfield ..... D28/46
D843,060 S * 3/2019 Fyfield ..... D28/48
10,493,644 B2 * 12/2019 Bozikis ..... B26B 21/4012
D874,725 S * 2/2020 Riehle ..... D28/46
D874,727 S 2/2020 Washington et al.
D882,175 S * 4/2020 Riehle ..... D28/48
2002/0000040 A1 1/2002 Gilder
2003/0046817 A1 3/2003 Coffin
2003/0046819 A1 * 3/2003 Ferraro ..... B26B 21/225 30/527
2004/0025350 A1 2/2004 Richard et al.
2004/0181954 A1 * 9/2004 Follo ..... B26B 21/222 30/527
2005/0039338 A1 * 2/2005 King ..... B26B 21/225 30/50
2005/0246898 A1 11/2005 Gilder
2007/0028449 A1 * 2/2007 King ..... B26B 21/225 30/49
2008/0115366 A1 * 5/2008 Follo ..... B26B 21/225 30/50
2008/0189964 A1 * 8/2008 Bozikis ..... B26B 21/521 30/526
2009/0038167 A1 * 2/2009 Peyser ..... B26B 21/225 30/532
2009/0199406 A1 * 8/2009 Gratsias ..... B26B 21/38 30/526
2010/0005669 A1 * 1/2010 Winter ..... B26B 21/522 30/526
2010/0058595 A1 3/2010 Walker, Jr. et al.
2011/0094108 A1 4/2011 Wain
2012/0124840 A1 * 5/2012 Iaccarino ..... B26B 21/225 30/50
2012/0192431 A9 8/2012 Wain
2013/0081276 A1 * 4/2013 Wain ..... B26B 21/225 30/50
2013/0205595 A1 8/2013 Bykowski et al.
2014/0059862 A1 * 3/2014 Efthimiadis ..... B26B 21/225 30/50
2014/0068953 A1 * 3/2014 Wonderley ..... B26B 21/521 30/527
2015/0314467 A1 * 11/2015 Bridges ..... B26B 21/14 30/51
2016/0121495 A1 * 5/2016 Johnson ..... B26B 21/521 30/532
2016/0129603 A1 * 5/2016 Antoniou ..... B26B 21/4081 30/50
2016/0144519 A1 * 5/2016 Hahn ..... B26B 21/521 30/50
2016/0158948 A1 6/2016 Eagleton
2016/0250765 A1 * 9/2016 Gratsias ..... B26B 21/225 30/526
2018/0236677 A1 8/2018 Blatter
2019/0299457 A1 10/2019 Long
2019/0337174 A1 * 11/2019 Kopelas ..... B26B 21/521
2019/0351568 A1 11/2019 Kim et al.
2019/0366570 A1 * 12/2019 Kopelas ..... B26B 21/225
2019/0375123 A1 12/2019 Park et al.
2020/0009754 A1 * 1/2020 Provost ..... B26B 21/4012
2020/0070374 A1 * 3/2020 Long ..... B26B 21/521

* cited by examiner

FIG. 8
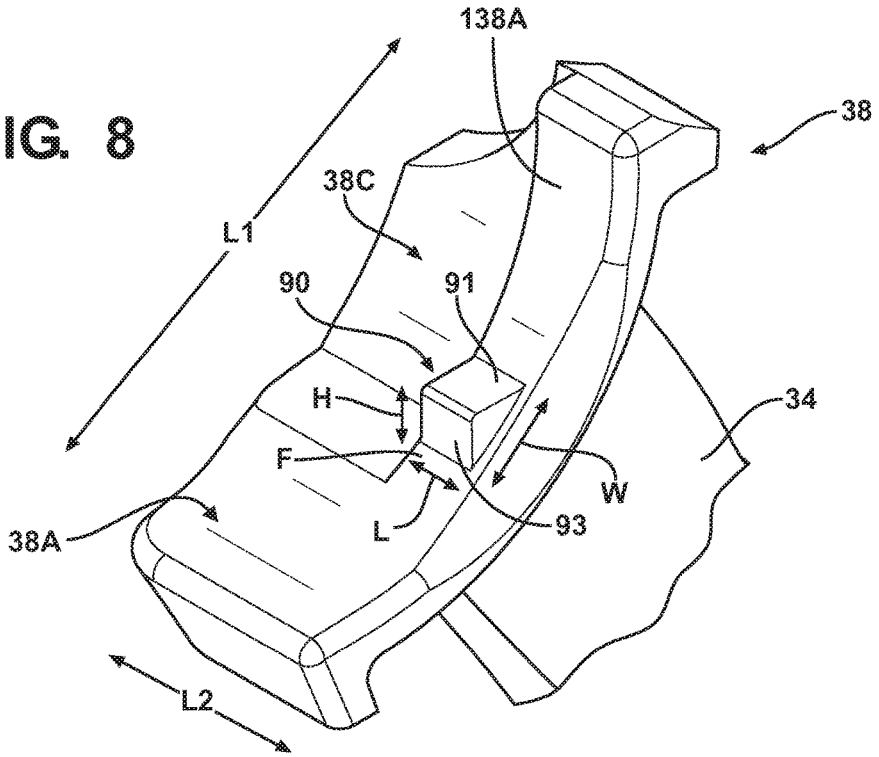
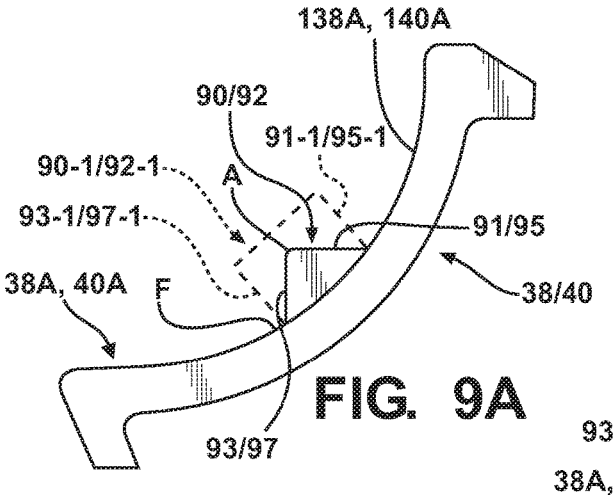
FIG. 9A
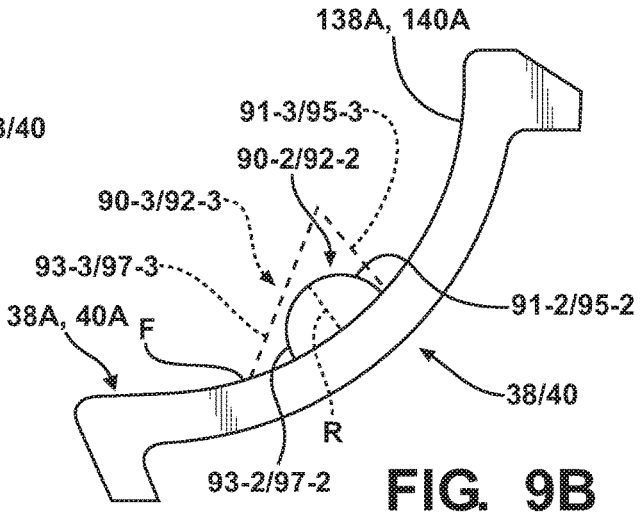
FIG. 9B

RAZOR STRUCTURE

FIELD OF THE INVENTION

The invention generally relates to a shaving razor having a handle and a replaceable razor cartridge, and more particularly to a handle with a one or more inner bearing stops.

BACKGROUND OF THE INVENTION

Shaving systems typically consist of a shaving razor with a handle and a replaceable razor cartridge. The handle often utilizes shell bearings to provide a continuous, curved surface around which the razor cartridge can pivot and contour to the face of the user. These shell bearings typically incorporate one or more outer surface features, such as one or more outer surface stops disposed on the outer surface of the shell bearing, that help to control a range of motion of the cartridge with respect to the handle. These features should be robust enough to withstand extreme consumer use conditions without breaking and without allowing the cartridge or other component of the razor to detach, while still allowing the cartridge to pivot freely with respect to the handle.

It would be desirable to provide a handle for a shaving razor that more robustly controls the range of motion of the cartridge with respect to the razor, while still allowing the cartridge to pivot smoothly with respect to the handle.

SUMMARY OF THE INVENTION

In accordance with an aspect of the present disclosure, a razor handle is provided. The razor handle may comprise a main body and a head at one end of the main body. The head may comprise one or more inner surfaces for pivotally engaging with a razor cartridge and one or more protrusions disposed on the one or more inner surfaces.

In accordance with another aspect of the present disclosure, a razor system is provided. The razor system may comprise a razor handle comprising a main body and a head at one end of the main body, and a razor cartridge pivotally coupled to the razor handle. The head of the razor handle may comprise one or more inner handle surfaces and one or more protrusions disposed on the one or more inner handle surfaces. The razor cartridge may engage the one or more protrusions disposed on the one or more inner handle surfaces to limit pivotal movement of the razor cartridge with respect to the head.

In accordance with a further aspect of the present disclosure, a razor handle is provided. The razor handle may comprise a main body and a head at one end of the main body. The head may comprise one or more shell bearings having one or more inner surfaces with one or more protrusions disposed thereon.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

FIG. 8 is a detailed perspective view of a shell bearing in accordance with the present disclosure;

FIGS. 9A and 9B are detailed side views of a portion of a shell bearing with protrusions in accordance with the present disclosure;

DETAILED DESCRIPTION OF THE INVENTION

Figure 1:
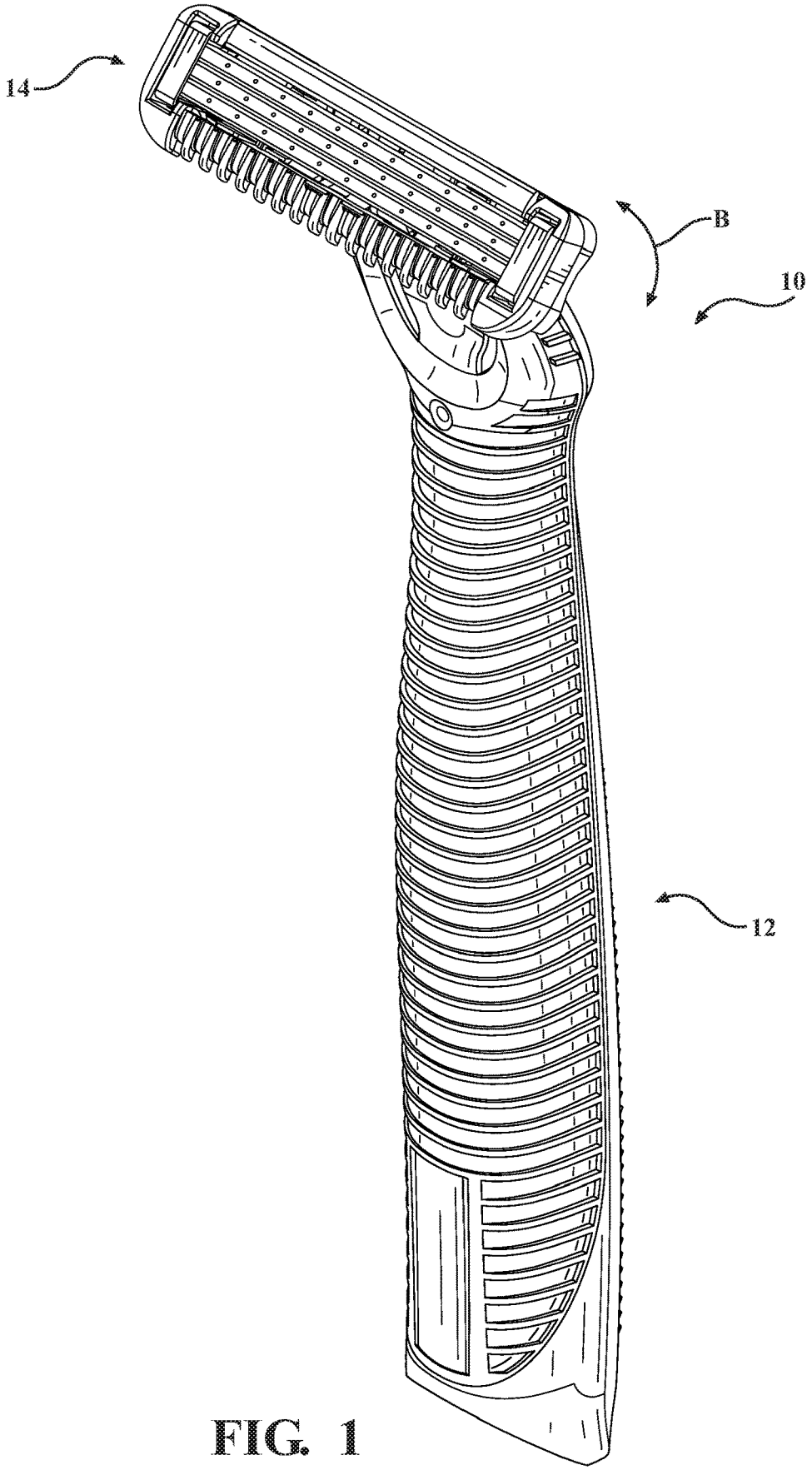
FIG. 1 is a perspective view of a shaving razor in accordance with the present disclosure.

Referring to FIGS. 1-4, a shaving razor 10 may comprise a razor handle 12 and a razor cartridge 14, which may be releasably coupled to the handle 12. The razor cartridge 14 may comprise a housing 16 that includes a front portion 21, a back portion 23, a first end portion 25, a second end portion 27, a top portion 26, and a bottom portion or underside 28. The front and back portions 21, 23 are spaced apart in a longitudinal direction of the cartridge 14, as shown by line $L_1$; the first and second end portions 25, 27 are spaced apart in a lateral direction of the cartridge 14, as shown by line $L_2$; and the top and bottom portions 26, 28 are spaced apart in a Z-direction of the cartridge 14, as shown by line $L_3$. Line $L_1$ may define a minor axis of the cartridge 14, and line $L_2$ may define a major axis of the cartridge 14.

The front portion 21 of the housing 16 comprises a guard structure 18, and the back portion 23 comprises a cap structure 19 that may include one or more lubricating and/or moisturizing strips 20. The housing 16 may carry one or more blades 22 extending in the lateral direction (the blades are removed in FIG. 4). The housing 16 of the cartridge 14 may comprise a polymeric material including, but not limited to, polypropylene, high impact polystyrene, polyphenylene oxide, and/or blends thereof. One or more components of the housing 16 may also be made from a thermoplastic elastomer. Clips 24 disposed on the first and second end portions 25, 27 of the cartridge 14 assist in retaining the blades 22 in the housing 16. The cartridge 14 may be coupled to the handle 12 via one or more shell bearings, wherein the embodiment illustrated in FIGS. 5 and 6 comprises first and second shell bearings 38, 40, or any other feasible mechanism, and the cartridge 14 may pivot relative to the handle 12, as described in more detail below.

Figure 5:
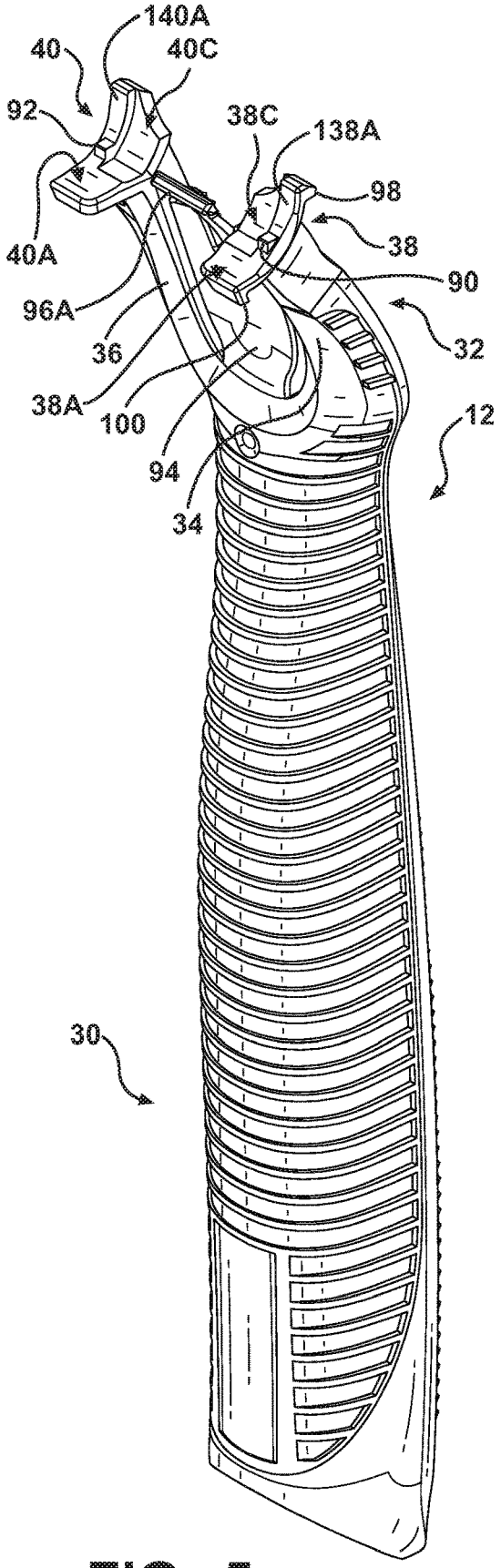
FIG. 5 is a perspective view of a razor handle of the shaving razor of FIG. 1.
Figure 6:
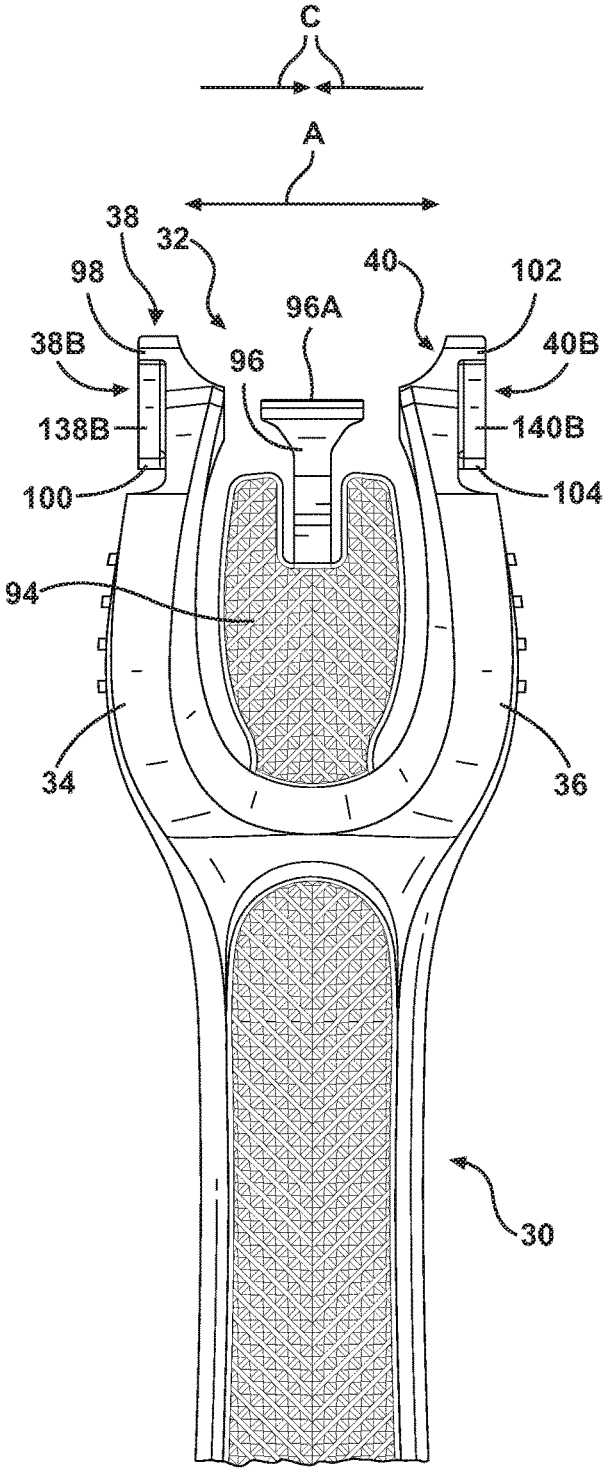
FIG. 6 is a back view of a portion of the razor handle of FIG. 5.

With reference to FIGS. 5 and 6 in which the razor cartridge 14 has been removed, the handle 12 may comprise a main body 30 and a head 32 at one end of the main body 30. The main body 30 may comprise an elongated structure that may be partially hollow. The head 32 may comprise a first arm 34 and a second arm 36, each of which is integral with and extends from the main body 30. The arms 34, 36 may be movable relative to one another in a direction indicated by arrows A and C to allow the cartridge 14 to be releasable coupled to the handle 12, as described in more detail below. The main body 30 and the head 32 may comprise a polymeric material including, but not limited to, polypropylene, polyethylene, and acrylonitrile butadiene styrene polymers. Portions of the main body 30 and/or the head 32 may comprise a softer gripping material (not separately labeled) with a plurality of grooves. The gripping material may comprise a polymeric material including, but not limited to, a thermoplastic elastomer.

As discussed further below, the head 32 comprises one or more inner surfaces and one or more outer surfaces for pivotally engaging the cartridge 14. As shown in FIGS. 5 and 6, the first arm 34 may comprise the first shell bearing 38 coupled to an end of the first arm 34 opposite the main body 30, and the second arm 36 may comprise the second shell bearing 40 coupled to an end of the second arm 36 opposite the main body 30. The first shell bearing 38 comprises an inner surface 38A that defines a first inner bearing portion 138A and an outer surface 38B that defines a first outer bearing portion 138B. The second shell bearing 40 comprises an inner surface 40A that defines a second inner bearing portion 140A and an outer surface 40B that defines a second outer bearing portion 140B. The inner surfaces 38A, 40A of the first and second shell bearings 38, 40 may each optionally comprise a recess 38C, 40C.

The handle 12 may further comprise a center extension 94 and spring-biased member 96 extending outwardly from the center extension 94, wherein both the extension 94 and spring-biased member 96 are located between the arms 34, 36. The spring-biased member 96 is flexible and comprises a tab 96A at its outermost end opposite the extension 94 and the main body 30. Because the spring-biased member 96 is flexible, the tab 96A is capable of flexing in the longitudinal direction (see FIGS. 2 and 4) so as to move with the cartridge 14 as it pivots relative to the handle 12, specifically with respect to the head 32, in a direction indicated by arrow B in FIG. 1. The outer bearing portions 138B, 140B may comprise a substantially continuously curved surface, and one or more outer stops 98, 100, 102, 104 may be disposed on one or more of the outer bearing portions. As described in more detail below, one or more protrusions 90, 92 disposed on one or more of the inner bearing portions 138A, 140A may define an inner bearing stop.

Figure 2:
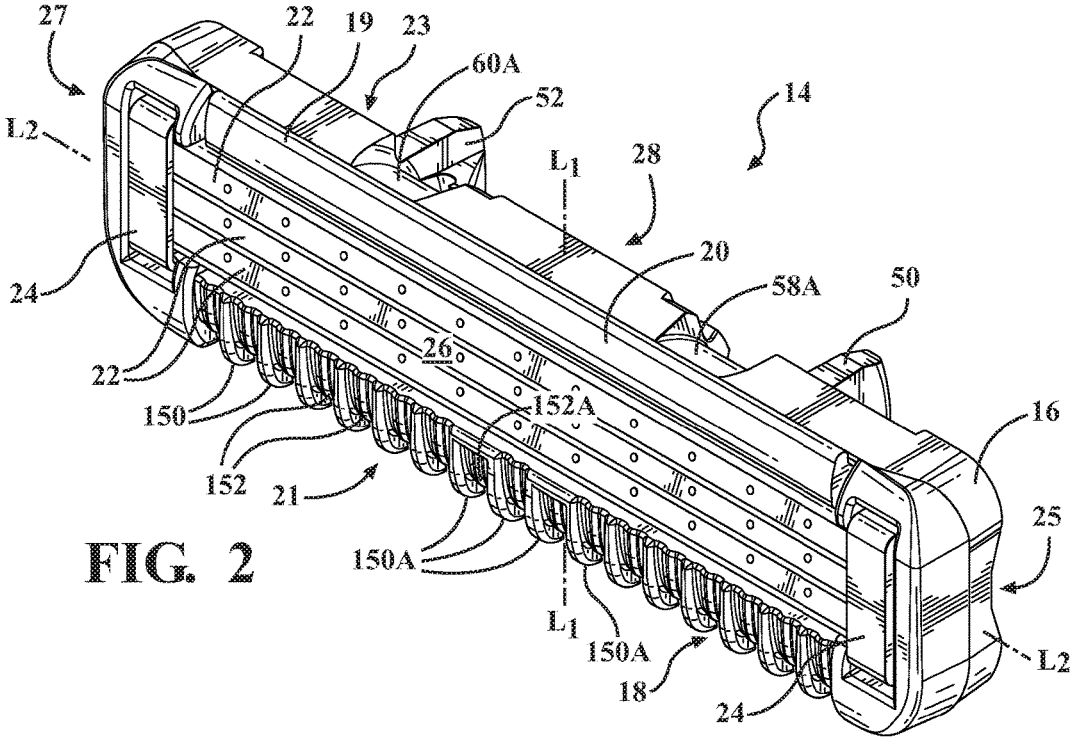
FIG. 2 is a perspective view of a razor cartridge of the shaving razor of FIG. 1.
Figure 3:
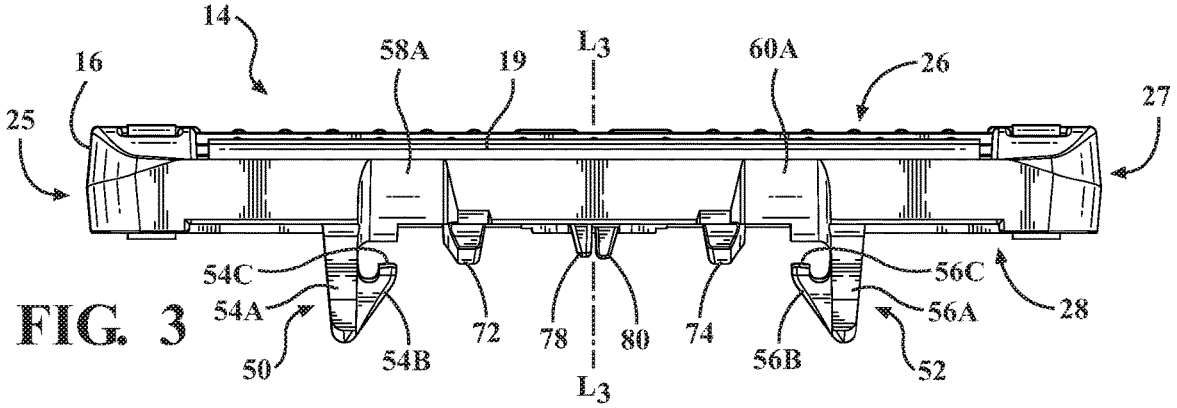
FIG. 3 is a plan view of a back portion of the razor cartridge of FIG. 2.
Figure 4:
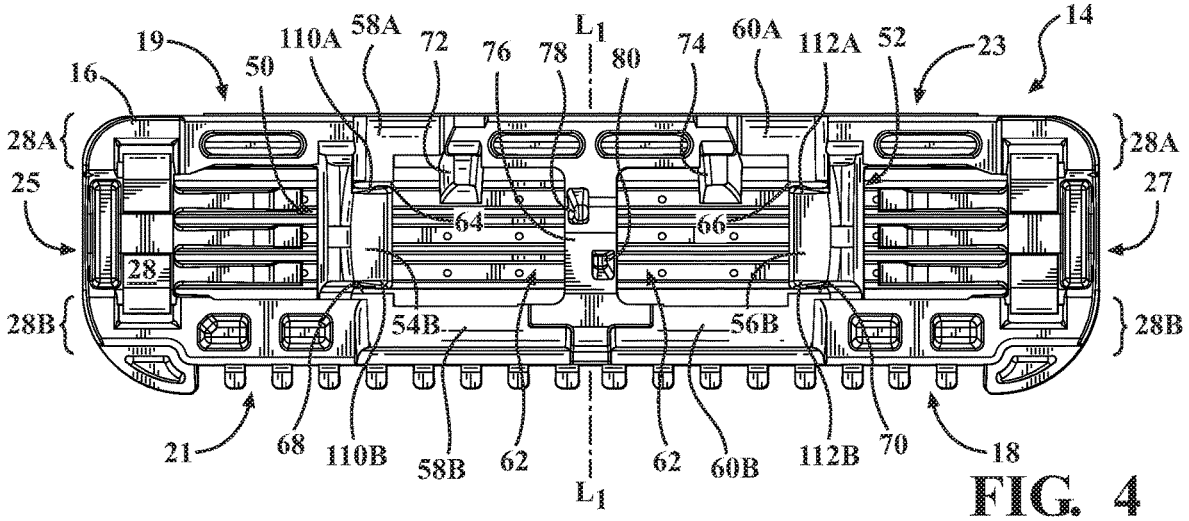
FIG. 4 is a plan view of a bottom portion of the razor cartridge of FIG. 2, in which the blades have been removed.

As shown in FIGS. 2-4, the bottom portion 28 of the housing 16 of the razor cartridge 14 comprises one or more handle engaging surfaces and/or structures. For example, the housing 16 comprises one or more extensions, wherein first and second extensions 50, 52 are provided in the illustrated embodiment, extending outward from the bottom portion 28. The first extension 50 comprises a support portion 54A extending outwardly from and integral with the bottom portion 28 and a first engagement rail 54B having a first inwardly facing, curved engagement surface 54C. The second extension 52 comprises a second support portion 56A extending outwardly from and integral with the bottom portion 28 and a second engagement rail 56B having a second inwardly facing, curved engagement surface 56C. As will be discussed further below, when the cartridge 14 is mounted to the handle 12, the first and second engagement surfaces 54C and 56C engage and are capable of moving along the first and second outer bearing portions 138B and 140B of the first and second shell bearings 38 and 40.

With reference to FIGS. 3 and 4, a first section 28A of the bottom portion 28 of the housing 16 adjacent to the cap structure 19 comprises first and second curved upper cartridge bearing surfaces 58A, 60A, and a second section 28B of the bottom portion 28 of the housing 16 adjacent to the guard structure 18 comprises first and second curved lower cartridge bearing surfaces 58B, 60B. The upper and lower cartridge bearing surfaces 58A, 58B, 60A, 60B are also referred to herein as inner cartridge bearing surfaces. As shown in FIG. 4, an opening 62 may be defined by the housing 16 such that the upper cartridge bearing surfaces 58A, 60A are spaced apart from and discontinuous with the lower cartridge bearing surfaces 58B, 60B. The support portions 54A, 56A of the first and second extensions 50, 52 may span between the first and second sections 28A and 28B of the bottom portion 28 of the housing 16 and across the opening 62.

The upper cartridge bearing surfaces 58A, 60A may each comprise an upper projection 64, 66 (also referred to herein as "handle engaging portions") that extends in the longitudinal direction into the opening 62 toward the lower cartridge bearing surfaces 58B, 60B. The lower cartridge bearing surfaces 58B, 60B may each comprise a lower projection 68, 70 (also referred to herein as "handle engaging portions") that extends in the longitudinal direction into the opening 62 toward the upper cartridge bearing surfaces 58A, 60A. One or more additional projections 72, 74 may be formed on a portion of the housing 16 adjacent to the cap structure 19. The projections 72, 74 may extend outward from the bottom portion 28 of the housing 16 in the Z-direction and may also extend in the longitudinal direction into the opening 62 toward the lower cartridge bearing surfaces 58B, 60B.

A cam structure 76 extends between the first and second sections 28A and 28B of the bottom portion 28 of the housing 16 and across the opening 62. Extending outward from the cam structure 76 in the Z-direction of the cartridge 14 are an upper extension 78 and a lower extension 80. The upper and lower extensions 78, 80 are adapted to be engaged by the tab 96A of the spring-biased member 96 when the cartridge 14 is mounted to the handle 12, as will be discussed further below. As shown in FIG. 4, the upper and lower extensions 78, 80 may be spaced apart in the longitudinal direction. The upper and lower extensions 78, 80 may also be offset from each other in the lateral direction. As described in more detail in concurrently filed, commonly assigned U.S. patent application Ser. No. 16,122,164 entitled RAZOR CARTRIDGE GUARD STRUCTURE, the guard structure 18 of the cartridge 14 may comprise a plurality of first and second protrusions 150, 150A, 152, 152A.

With reference to FIGS. 1 and 3-7, the razor cartridge 14 may be installed on the handle 12, for example, by a user moving the arms 34, 36 toward each other in the direction indicated by the arrows C in FIG. 6 and pushing the head 32 of the handle 12 against the bottom portion 28 of the cartridge 14. The first inner bearing portion 138A defined by the inner surface 38A of the first shell bearing 38 receives the inner cartridge bearing surfaces 58A, 58B located toward the first end portion 25 of the cartridge 14, and the outer surface 38B of the first shell bearing 38 is received in and engages with the first inwardly facing, curved engagement surface 54C of the first extension 50. The second inner bearing portion 140A defined by the inner surface 40A of the second shell bearing 40 receives the inner cartridge bearing surfaces 60A, 60B located toward the second end portion 27 of the cartridge 14, and the outer surface 40B of the second shell bearing 40 is received in and engages with the second inwardly facing, curved engagement surface 56C of the second extension 52. A curvature of the inner and outer surfaces 38A, 40A, 38B, 40B of the first and second shell bearings 38, 40 may substantially correspond to a curvature of the respective cartridge bearing surfaces 58A, 60A, 58B, 60B and curved engagement surfaces 54C, 56C so that the cartridge 14 is able to pivot smoothly relative to the handle 12, specifically with respect to the head 32, in a direction indicated by arrow B in FIG. 1. The projections 72, 74 are received in respective ones of the recesses 38C, 40C formed in the inner surfaces 38A, 40A of the shell bearings 38, 40. The projections 72, 74 and recesses 38C, 40C ensure that the cartridge 14 is installed in the correct orientation, and the projections 72, 74 prevent engagement of the shell bearings 38, 40 with the cartridge 14 if the user attempts to install the cartridge 14 upside down.

Figure 7:
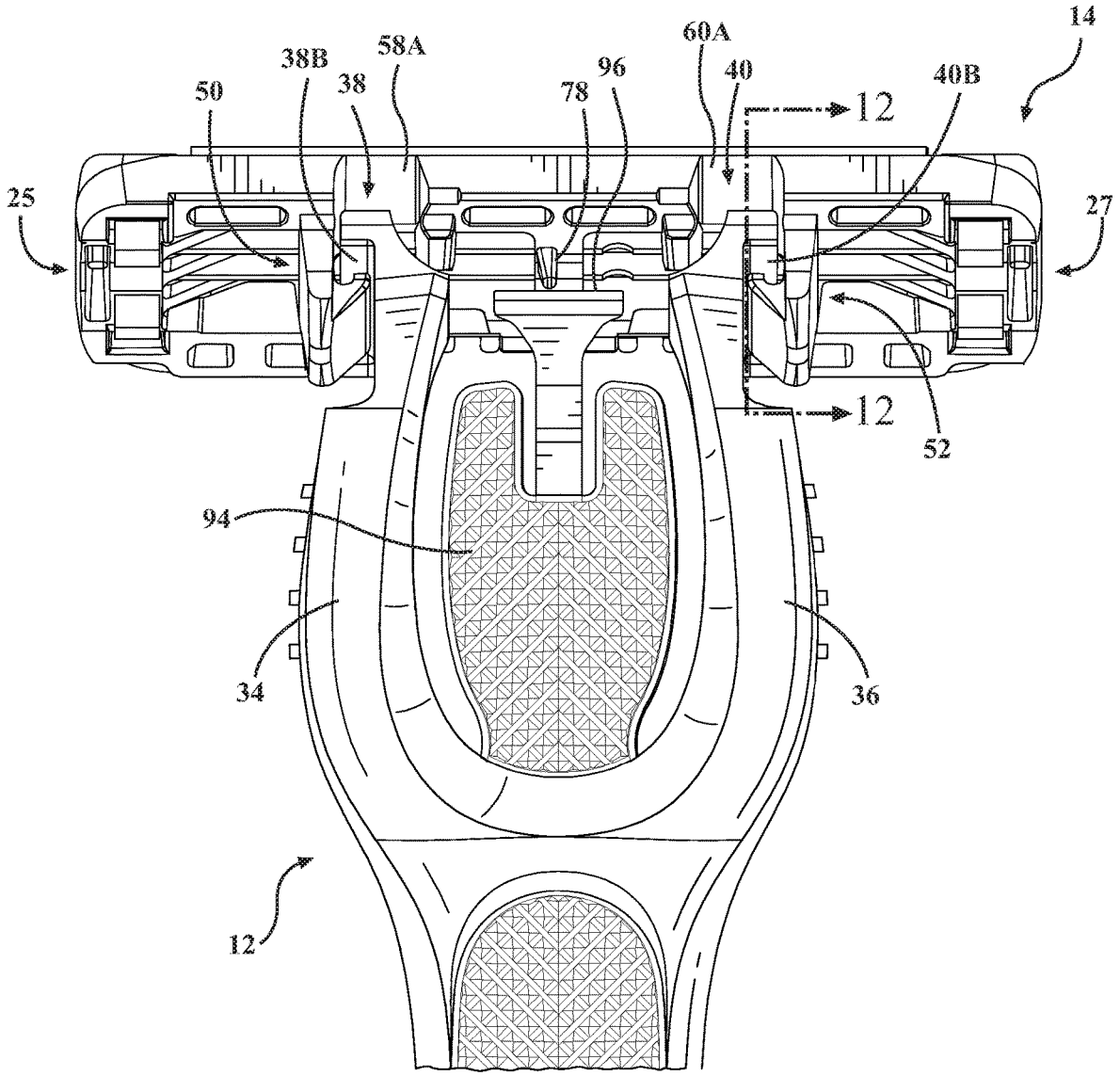
FIG. 7 is a back view of a portion of the shaving razor of FIG. 1.

The tab 96A of the spring-biased member 96 is received between the upper and lower extensions 78, 80 formed on the cam structure 76 and acts against the upper and lower extensions 78, 80 to urge the razor cartridge 14 to a given position, e.g., a home position as shown in FIG. 1 (see also FIG. 7). During use, the cartridge 14 is allowed to pivot in the direction indicated by arrow B as it moves along and follows the contour of a portion of a user's body, e.g., face, due to the flexibility of the spring-biased member 96. When the cartridge 14 is removed from the user's skin, the spring-biased member 96 returns the cartridge 14 to its home position relative to the handle 12.

Figure 10:
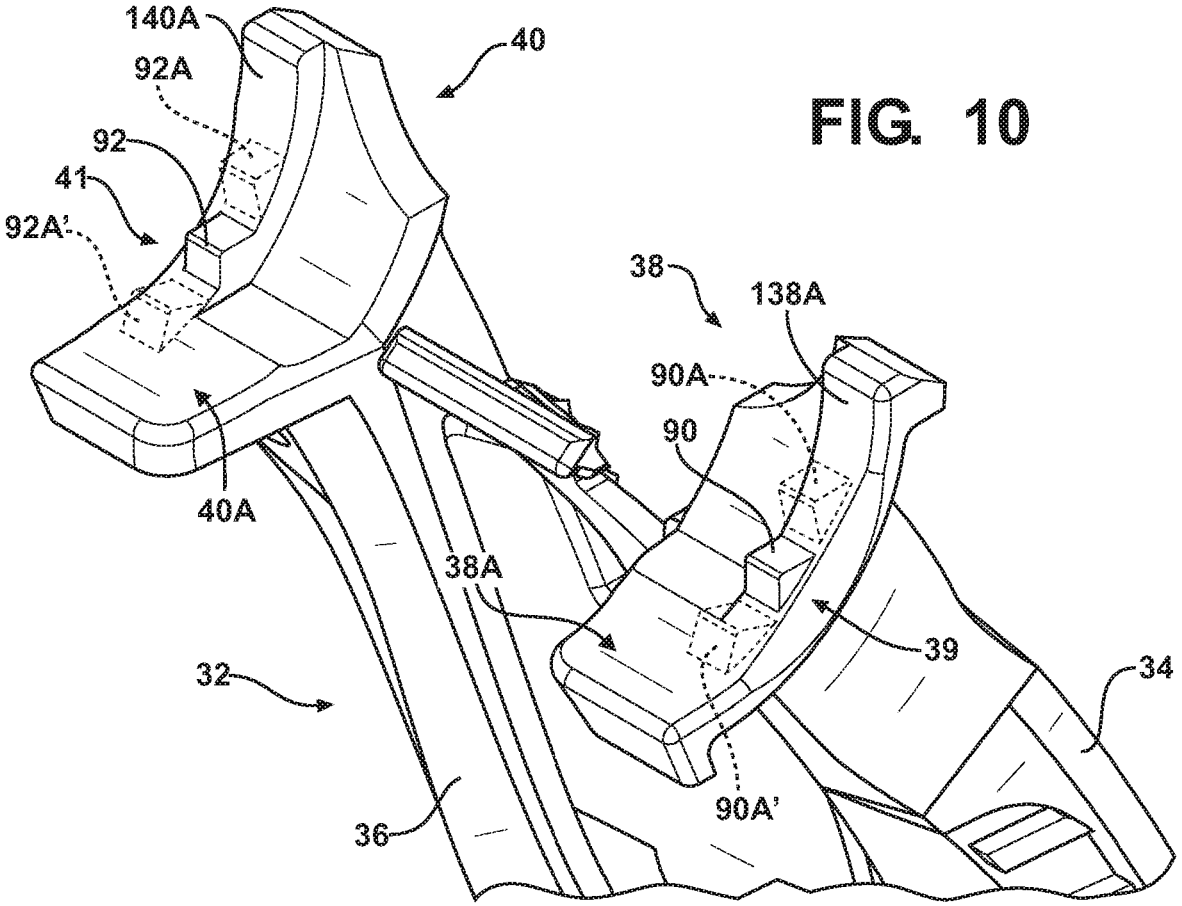
FIG. 10 is a detailed perspective view of a portion of a razor handle in accordance with the present disclosure.
Figure 11:
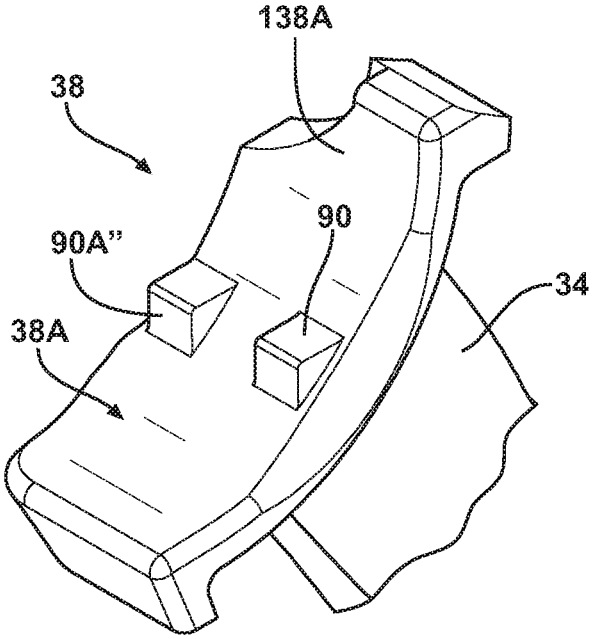
FIG. 11 is a detailed perspective view of a shell bearing in accordance with the present disclosure.

As noted above, one or more protrusions 90, 92 may be disposed on one or more of the inner bearing portions 138A and 140A to define inner bearing stops. The protrusions described herein may comprise any suitable dimensions and/or shape, and one or more protrusions may be disposed at any suitable location along the respective inner bearing portion. FIG. 8 is a perspective view of the first shell bearing 38 comprising a protrusion 90 having specified dimensions. FIGS. 9A and 9B are side views of a portion of the first and second shell bearings 38, 40 comprising protrusions 90, 90-1, 90-2, 90-3, 92, 92-1, 92-2, 92-3 of varying shapes. FIGS. 10 and 11 are perspective views of one or both shell bearings 38, 40 comprising one or more protrusions 90, 90A, 90A', 90A", 92, 92A, 92A' disposed at varying locations.

In the embodiment illustrated in FIGS. 5 and 8, a first protrusion 90 may comprise a height H, a length L, and a depth or width W, in which the height H may be measured with respect to a floor F of an adjacent section of the inner surface 38A of the shell bearing 38 on which the protrusion 90 is formed (see also FIGS. 9A and 9B); the length L may be measured in a lateral direction as indicated by line $L_2$; and the width W may be measured in a longitudinal direction as indicated by line $L_1$. The inner surface 38A may comprise a recess 38C extending along at least a section of the shell bearing 38 in the lateral and longitudinal directions. The protrusion 90 is formed on a section of the inner surface 38A that does not comprise the recess 38C, such that the height H of the protrusion 90 is exclusive of the recess 38C and reflects an amount by which the protrusion 90 extends above the floor F of the inner surface 38A of the shell bearing 38. One or more of the height H, length L, and width W of the protrusion 90 may be varied. In some examples, the protrusion 90 may comprise a height H of about 1 mm, a length L of about 1 mm, and a width W of about 1.5 mm. In other examples, the height H and/or width W may be greater than 0% but less than or equal to 30% of a total longitudinal dimension of the inner surface 38A, as measured in the longitudinal direction. In further examples, the length L may be greater than or equal to 30% of a total lateral dimension of the inner surface 38A, as measured in the lateral direction, and in some particular examples, the length L may be such that the protrusion 90 extends across substantially an entirety of the inner surface 38A in the lateral direction.

In the example shown in FIG. 8, the protrusion 90 extends across only a small section of the inner surface 38 in the lateral direction, and the recess 38C extends along greater than or equal to 50% of the total longitudinal dimension and/or across greater than or equal to 50% of the total lateral dimension, as measured in the respective longitudinal and lateral directions, of the inner surface 38A. In other examples (not shown) in which the protrusion 90 extends across substantially an entirety of the inner surface 38A in the lateral direction and/or comprises an increased width W in the longitudinal direction, the recess 38C may extend along less than 50% of the total longitudinal dimension and/or across less than 50% of the total lateral dimension of the inner surface 38A.

The protrusions described herein may also comprise any suitable shape and may comprise one or more sloped planar surfaces, perpendicular planar surfaces, curved surfaces, or any combination thereof. The shape of the protrusions are described below with respect to solid geometry or three-dimensional shapes, with a bottom surface of each shape being defined by the inner surface 38A, 40A of the shell bearing 38, 40 on which the protrusion is integrally formed.

As shown in FIGS. 9A and 10-14, the protrusion 90, 92 may comprise one or more sloped planar surfaces and may comprise, for example, a triangular prism or wedge shape with respective first and second substantially planar faces or surfaces 91, 93 and third and fourth substantially planar faces or surfaces 95, 97. The substantially planar surfaces 91, 93, 95, 97 extend outward from the floor F of the inner surface 38A, 40A of the shell bearing 38, 40 and slope toward each other at an angle greater than 90° with respect to the floor F of the inner surface 38A, 40A of the shell bearing 38, 40, joining at an uppermost vertex or apex A.

It is also contemplated that the surfaces of the first and second protrusions may comprise perpendicular planar surfaces, curved surfaces, and the like. For example, as shown in phantom in FIG. 9A, the protrusion 90-1, 92-1 may comprise one or more perpendicular planar surfaces and may comprise, for example, a cube or cuboid shape with respective first and second substantially planar surfaces 91-1, 93-1 and third and fourth substantially planar surfaces 95-1, 97-1, respectively, that extend upward at approximately 90°, i.e., perpendicularly, with respect to the floor F of the inner surface 38A, 40A of the shell bearing 38, 40. The cube or cuboid shape is completed by an additional substantially planar surface (not separately labeled) that extends between respective ones of the first and second planar surfaces 91-1, 93-1 and the third and fourth planar surfaces 95-1, 97-1 and joins them at a vertex. In further examples, the protrusion 90-2, 92-2 as shown in FIG. 9B may comprise a curved surface defining, for example, a substantially hemispherical shape comprising first and second curved sections 91-2, 93-2 and third and fourth curved sections 95-2, 97-2, respectively. The first and second curved sections 91-2, 93-2 and third and fourth curved sections 95-2, 97-2 may be defined between the floor F and an imaginary radius line R extending through a center of the hemisphere perpendicular to the floor F.

In yet further examples, the protrusion may comprise a combination of one or more sloped, perpendicular, and/or curved surfaces. For example, as shown in phantom in FIG. 9B, the first protrusion 90-3, may comprise a modified triangular prism or wedge shape, in which a first substantially planar surface 91-3 extends upward at approximately 90°, i.e., perpendicularly, with respect to the floor F and a second sloped substantially planar surface 93-3 slopes toward and joins the first surface 91-3 at an apex (not separately labeled). The second protrusion 92-3 similarly comprises a third substantially planar surface 95-3 that extends upward at approximately 90°, i.e., perpendicularly, with respect to the floor F and a fourth sloped substantially planar surface 97-3 that slopes toward and joins the third surface 95-3 at the apex. The first and second protrusions 90-1 to 90-3 and 92-1 to 92-3 may each comprise any suitable height, length, or width, and may extend fully or partially across the inner surface 38A, 40A of the shell bearing 38, 40, as described above in detail with respect to the protrusion 90 and shown in FIG. 8.

In the protrusions 90, 90-1, 92, 92-1 depicted in FIG. 9A, a length of each first and third planar surfaces 91, 91-1, 95, 95-1, as defined between the floor F and the apex or vertices, may be substantially equal to a length of the corresponding second and fourth planar surfaces 93, 93-1, 97, 97-1. A length of the first and third curved sections 91-2, 95-2 and second and fourth curved sections 93-2, 97-2, as defined between the floor F and line R, of the protrusion 90-2, 92-2 may also be substantially equal. In the protrusion 90-3, 92-3, a length of the first and third substantially planar surfaces 91-3, 95-3 may be different from a length of the corresponding second and fourth substantially planar surfaces 93-3, 97-3.

As shown in FIG. 10, the first and second protrusions 90, 92 may both be disposed in a center or middle portion 39, 41 (as determined with respect to the longitudinal direction; see FIG. 8) of the inner bearing portions 138A, 140A defined by the inner surfaces 38A, 40A of the respective shell bearings 38, 40 to define first and second inner bearing stops. In other embodiments as shown in phantom in FIG. 10, both protrusions 90A, 92A may be disposed on the respective inner surface 38A, 40A above the middle portion 39, 41 of the shell bearing 38, 40, or both protrusions 90A', 92A' may be disposed on the respective inner surface 38A, 40A below the middle portion 39, 41 of the shell bearing 38, 40. In further embodiments, the protrusions may be offset from each other. For example, with continued reference to FIG. 10, the first shell bearing 38 may comprise the protrusion 90A that is located above the middle portion 39 of the first shell bearing 38, and the second shell bearing 40 may comprise the protrusion 92A' that is located below the middle portion 41 of the second shell bearing 40. Alternatively, the first shell bearing 38 may comprise the protrusion 90A', and the second shell bearing 40 may comprise the protrusion 92A.

In some examples, each shell bearing 38, 40 may comprise one protrusion 90, 92, as shown in FIGS. 5 and 8. In other embodiments, each shell bearing 38, 40 may comprise two or more protrusions. For example, as shown in FIG. 11 with respect to the first shell bearing 38, two protrusions 90, 90A" may be disposed on the inner surface 38A. As described below, in all examples, one or more dimensions of one or more of the upper and lower projections 64, 66, 68, 70 formed on the upper and lower cartridge bearing surfaces 58A, 58B, 60A, 60B of the cartridge 14 may also be adjusted to ensure that the projections 64, 66, 68, 70 engage the protrusions 90, 92 at the desired location as the cartridge 14 pivots relative to the handle 12. Although not shown, the second shell bearing 40 may similarly comprise two or more protrusions.

Figure 12:
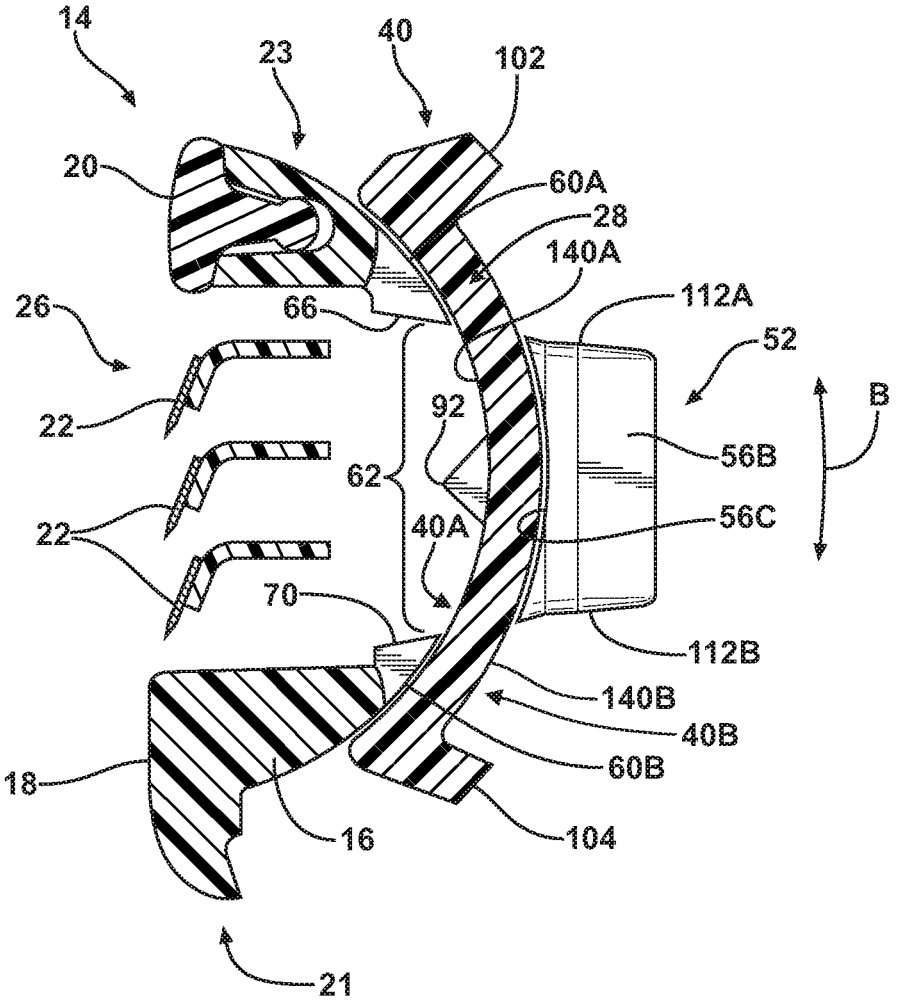
FIG. 12 is a cross-sectional view taken along line 12-12 in FIG. 7 of a portion of the shaving razor, in which one end portion of the cartridge has been removed.
Figure 13:
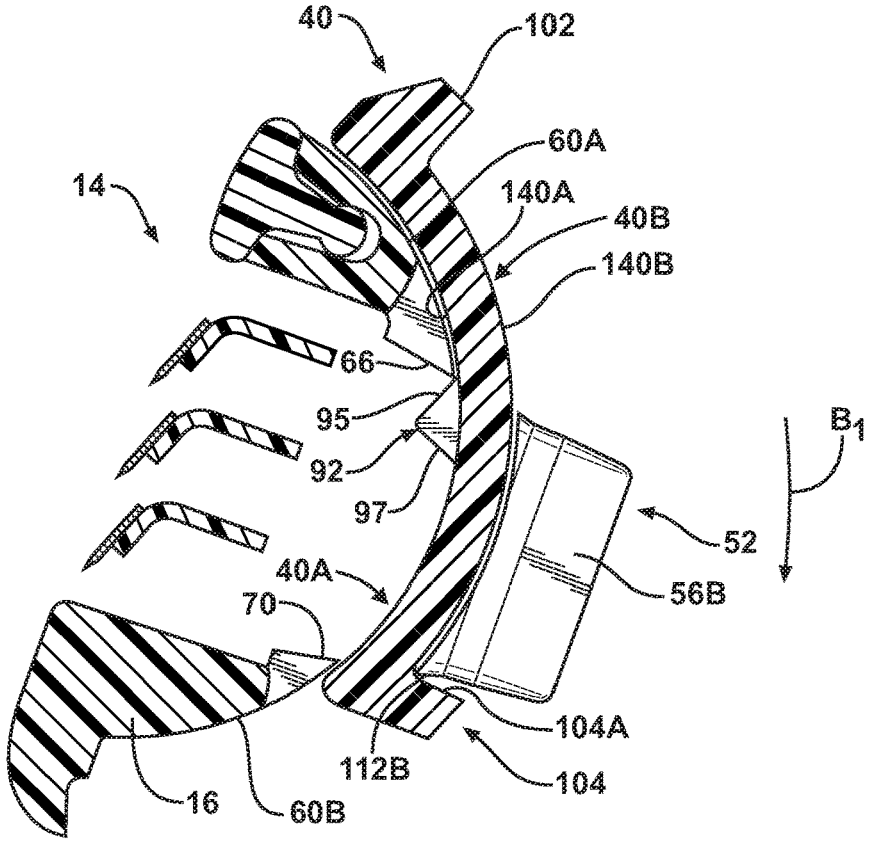
FIG. 13 is a cross-sectional view of the portion of the shaving razor of FIG. 12 illustrating pivoting of the cartridge in a first direction with respect to the handle.
Figure 14:
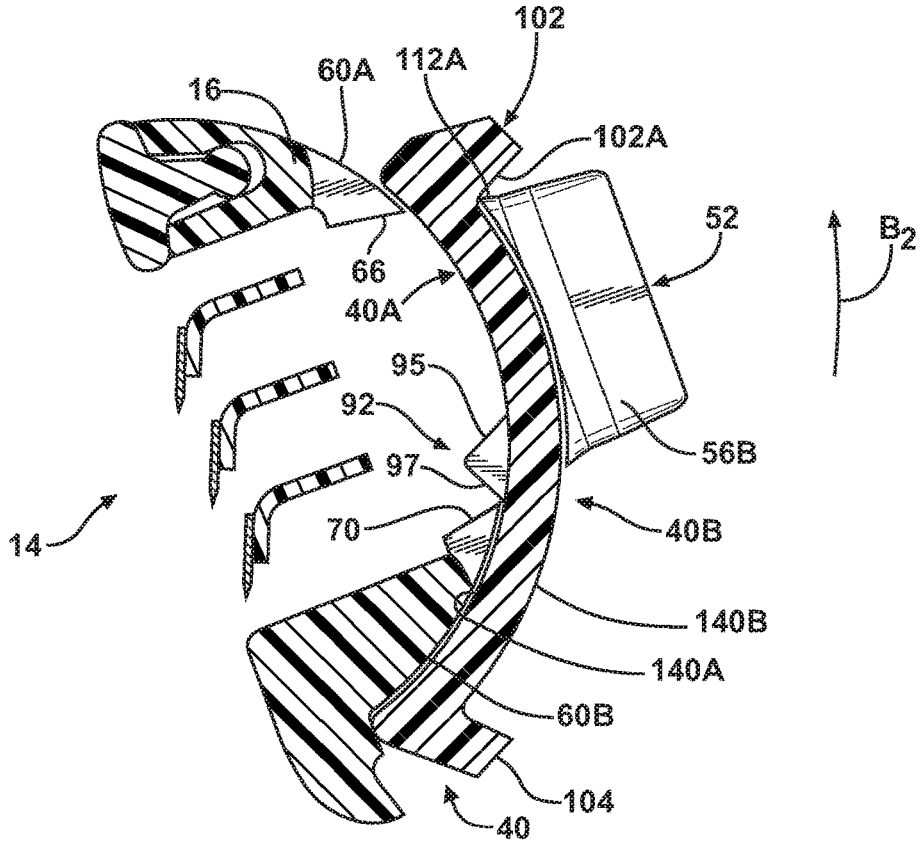
FIG. 14 is a cross-sectional view of the portion of the shaving razor of FIG. 12 illustrating pivoting of the cartridge in a second direction with respect to the handle.

Further in the embodiments illustrated in FIGS. 5 and 6, first and second outer stops 98 and 100 may be located at outermost ends of the first outer bearing portion 138B, and third and fourth outer stops 102 and 104 may be located at outermost ends of the second outer bearing portion 140B (see also FIGS. 12-14).

During pivotal movement of the cartridge 14 relative to the handle 12, the first and second protrusions 90 and 92 and the first, second, third, and fourth outer stops 98, 100, 102, and 104 limit pivotal movement of the cartridge 14, in one or more directions, relative to the handle 12. FIGS. 12-14 are cross-sectional views of the second shell bearing 40 and the razor cartridge 14 taken along the line 12-12 in FIG. 7, in which the second support portion 56A of the second extension 52 and the end portion 27 of the cartridge 14 behind the second support portion 56A are removed to illustrate aspects of the structure in more detail.

As shown in FIG. 12, the inner bearing portion 140A defined by the inner surface 40A of the second shell bearing 40 receives the upper and lower cartridge bearing surfaces 60A, 60B of the cartridge 14. When the cartridge 14 is in a home position as shown in FIG. 12, the upper and lower projections 66, 70 formed on the upper and lower cartridge bearing surfaces 60A, 60B, respectively, of the cartridge 14 may be located at a substantially equal distance from the protrusion 92 formed on the inner surface 40A of the shell bearing 40. The outer surface 40B of the shell bearing 40, which defines the outer bearing portion 140B, engages with the inwardly facing, curved engagement surface 56C of the engagement rail 56B of the extension 52. A pair of outer stops 102, 104 are disposed at opposing ends of the outer bearing portion 140B. The extension 52 of the cartridge 14 may be located at a substantially equal distance from each of the outer stops 102, 104 when the cartridge 14 is in the home position. The cartridge 14 pivots relative to the head 32 (see FIG. 1), e.g., with respect to the shell bearing 40, in a direction indicated by arrow B.

With reference to FIG. 13, when the cartridge 14 is pivoted relative to the shell bearing 40 in a first direction, e.g., in a clockwise direction as indicated by arrow $B_1$, the upper projection 66 on the upper cartridge bearing surface 60A engages, i.e., contacts, the third planar surface 95 of the second protrusion 92, which prevents further pivotal movement of the cartridge 14 in the first direction. Substantially simultaneously, an outer back surface 112B of the extension rail 56B engages, i.e., contacts, an inner surface 104A of the outer stop 104 of the second outer bearing portion 140B, which further prevents pivotal movement of the cartridge 14 in the first direction.

With reference to FIG. 14, when the cartridge 14 is pivoted relative to the shell bearing 40 in a second direction, e.g., in a counter-clockwise direction as indicated by arrow $B_2$, the lower projection 70 on the lower cartridge bearing surface 60B engages, i.e., contacts, the fourth planar surface 97 of the second protrusion 92, which prevents further pivotal movement of the cartridge 14 in the second direction. Substantially simultaneously, an outer front surface 112A of the extension rail 56B engages, i.e., contacts, an inner surface 102A of the outer stop 102 of the second outer bearing portion 140B, which further prevents pivotal movement of the cartridge 14 in the second direction.

Although the features of the second shell bearing 40 are described in detail above, it is understood that the first shell bearing 38 may comprise a similar configuration that limits pivotal movement of the cartridge 14 in one or more directions. For example, when the cartridge 14 is pivoted relative to the head 32 in the first direction as shown in FIG. 13, the upper projection 64 on the upper cartridge bearing surface 58A engages the first planar surface 91 of the first protrusion 90, and substantially simultaneously, an outer back surface 110B of the extension rail 54B formed on the extension 50 engages the outer stop 100 (see FIGS. 3-8). Likewise, when the cartridge 14 is pivoted relative to the head 32 in the second direction as shown in FIG. 14, the lower projection 68 on the lower cartridge bearing surface 58B engages the second planar surface 93 of the first protrusion 90, and substantially simultaneously, an outer front surface 110A of the engagement rail 54B engages the outer stop 98 (see FIGS. 3-8).

In this manner, in some examples, the extensions 50, 52 extending outward from the bottom portion 28 of the cartridge 14 may cooperate with the upper projections 64, 66 formed on the upper cartridge bearing surfaces 58A, 60A to limit pivotal movement of the cartridge 14, in the first direction, with respect to the handle 12. Likewise, the extensions 50, 52 may cooperate with the lower projections 68, 70 formed on the lower cartridge bearing surfaces 58B, 60B to limit pivotal movement of the cartridge 14, in the second direction, with respect to the handle 12. In other examples, the upper or lower projections 64, 66 or 68, 70 may engage the protrusions 90, 92 prior to the extensions 50, 52 engaging the outer stops 98, 100, 102, 104, or the extensions 50, 52 may engage the outer stops 98, 100, 102, 104 prior to the upper or lower projections 64, 66 or 68, 70 engaging the protrusions 90, 92.

The dimensions, shape, and/or location of the protrusions 90, 92 as described herein may be used to limit and control a range of motion of the cartridge 14 in the direction indicated by the arrow B (see FIGS. 1 and 12). In addition, a length of the upper and lower projections 64, 66, 68, 70 formed on the upper and lower cartridge bearing surfaces 58A, 58B, 60A, 60B of the cartridge 14 (as measured in the longitudinal direction of the cartridge 14; see FIG. 4) may be used to further control the range of motion of the cartridge 14 and to ensure that the projections 64, 66, 68, 70 engage the protrusions 90, 92 at the appropriate location as the cartridge 14 pivots relative to the handle 12, as described in detail with respect to FIGS. 13 and 14. For example, when the protrusions 90A, 90A', 92A, 92A' are offset from each other as described with respect to FIG. 10, the length of the upper projection 64 formed on the upper cartridge bearing surface 58A may be different from the length of the upper projection 66 formed on the upper cartridge bearing surface 60A. Likewise, the length of the lower projections 68, 70 formed on the lower cartridge bearing surfaces 58B, 60B may be different, as compared to each other. One or more dimensions of the opening 62 defined by the housing 16 of the cartridge 14 may also be varied (see FIGS. 4 and 8).

Because the upper and lower projections 64, 66, 68, 70 may engage a respective one of the protrusions 90, 92 at substantially the same time as the engagement rails 54, 56 of the extensions 50, 52 engage a respective one of the outer stops 98, 100, 102, 104, a load or forces applied by the cartridge 14 to the shell bearings 38, 40 as the cartridge 14 stops may be distributed across a larger portion of each shell bearing 38, 40. That is, the forces applied by the upper and lower projections 64, 66, 68, 70 to the protrusions 90, 92 on the shell bearings 38, 40 and the forces applied by the engagement rails 54, 56 to the outer stops 98, 100, 102, 104 on the shell bearings 38, 40 may be applied substantially simultaneously and also applied at spaced apart locations along the shell bearings 38, 40 so as to more evenly distribute and balance the forces applied to the shell bearings 38, 40 by the cartridge 14, thereby providing a more robust system that can withstand extreme use conditions. Conventional handles employing only outer stops may not stop movement of the cartridge as securely and reliably and in some cases, may allow unwanted detachment of the cartridge. This balancing of the load also provides a smoother experience for the user as the pivoting motion of the cartridge 14, including both end portions 25, 27, is firmly halted by the substantially simultaneous engagement of the projections 64, 66, 68, 70 with the protrusions 90, 92 and the engagement rails 54, 56 with the outer stops 98, 100, 102, 104. In addition, the protrusions 90, 92 may help to prevent unwanted detachment of the cartridge 14 from the handle 12 and/or breakage of one or more of the outer stops 98, 100, 102, 104 when, for example, the shaving razor 10 is dropped or subjected to other impact forces.

With reference to FIGS. 3, 4, and 7, as described above, the tab 96 of the spring-biased member 94 is received between the upper and lower and extensions 78, 80 extending outward from the cam structure 76 in the Z-direction of the cartridge 14. When the cartridge 14 moves in the first direction as shown in FIG. 13, the tab 96 engages the upper extension 78. The tab 96 is deflected downward and acts against the upper extension 78 to urge the cartridge 14 back to the home position, as shown in FIG. 12. When the cartridge 14 moves in the second direction as shown in FIG. 14, the tab engages the lower extension 80. The tab 96 is deflected upward and acts against the lower extension 80 to urge the cartridge 14 back to the home position, as shown in FIG. 12.

Representative embodiments of the present disclosure described above can be described as follows:

A. A razor handle comprising:

a main body; and a head at one end of said main body, said head comprising one or more inner bearing surfaces for pivotally engaging with a razor cartridge and one or more protrusions disposed on said one or more inner bearing surfaces.

B. The razor handle of paragraph A, wherein said one or more protrusions are configured to limit pivotal movement of said razor cartridge with respect to said head.

C. The razor handle of paragraph A or B, wherein said one or more protrusions are configured to limit pivotal movement of said razor cartridge, in one or more directions, with respect to said head.

D. The razor handle of any of paragraphs A-C, wherein said head comprises at least one shell bearing comprising an inner surface that defines one of said one or more inner bearing surfaces.

E. The razor handle of any of paragraphs A-D, wherein said head comprises at least one shell bearing comprising:

an inner surface defining one of said one or more inner bearing surfaces;

one of said one or more protrusions disposed on said one inner bearing surface, wherein said one protrusion defines an inner bearing stop;

an outer surface defining an outer bearing surface; and at least one outer stop disposed on said outer bearing surface.

F. The razor handle of paragraph E, wherein said one protrusion is disposed in a middle portion of said one inner bearing surface and said at least one outer stop comprises a pair of outer stops disposed at opposing ends of said outer bearing surface.

G. The razor handle of any of paragraphs A-F, wherein said head comprises:

a first shell bearing comprising:

a first inner surface defining a first one of said one or more inner bearing surfaces;

a first one of said one or more protrusions disposed on said first inner bearing surface and defining a first inner bearing stop;

a first outer surface defining a first outer bearing surface; and at least one first outer stop disposed on said first outer bearing surface;

a second shell bearing comprising:

a second inner surface defining a second one of said one or more inner bearing surfaces;

a second one of said one or more protrusions disposed on said second inner bearing surface and defining a second inner bearing stop;

a second outer surface defining a second outer bearing surface; and at least one second outer stop disposed on said second outer bearing surface.

H. The razor handle of any of paragraphs A-G, wherein said one or more protrusions are disposed in a middle portion of said one or more inner bearing surfaces.

The razor handle of any of paragraphs A-H, wherein said one or more protrusions comprise a curved surface, a perpendicular substantially planar surface, a sloped substantially planar surface, or any combination thereof.

J. The razor handle of any of paragraphs A-I, wherein said one or more protrusions comprise a height of about 1 mm, a length of about 1 mm, and a width of about 1.5 mm.

K. The razor handle of any of paragraphs A-J, wherein said one or more protrusions comprise at least two protrusions that are offset from each other.

L. A razor system comprising:

a razor handle comprising a main body and a head at one end of said main body, said head comprising one or more inner handle bearing surfaces and one or more protrusions disposed on said one or more inner handle bearing surfaces; and a razor cartridge pivotally coupled to said razor handle, said razor cartridge engaging said one or more protrusions disposed on said one or more inner handle bearing surfaces to limit pivotal movement of said razor cartridge with respect to said head.

M. The razor system of paragraph L, wherein said razor cartridge comprises a housing, a bottom portion of said housing comprising inner cartridge bearing surfaces that are received in said one or more inner handle bearing surfaces.

N. The razor system of paragraph M, wherein at least one of said inner cartridge bearing surfaces further comprises one or more handle engaging surfaces that engage one of said one or more protrusions.

O. The razor system of paragraphs M or N, wherein said head further comprises one or more outer handle bearing surfaces, at least one outer stop being disposed on each of said outer handle bearing surfaces.

P. The razor system of paragraph O, wherein at least one of said inner cartridge bearing surfaces comprises a projection that engages said one or more protrusions disposed on said one or more inner handle bearing surfaces, and wherein said bottom portion of said housing comprises extensions that are received in said outer handle bearing surfaces and engage said outer stops, said extensions cooperating with said projections to limit said pivotal movement of said razor cartridge with respect to said head.

Q. The razor system of any of paragraphs L-P, wherein said head comprises:

first and second arms extending from said main body;

a first shell bearing coupled to an end of said first arm opposite said main body, comprising:

a first inner surface defining a first one of said one or more inner handle bearing surfaces;

a first one of said one or more protrusions disposed on said first inner handle bearing surface and defining a first inner bearing stop;

a first outer surface defining a first outer bearing surface; and at least one first outer stop disposed on said first outer bearing surface;

a second shell bearing coupled to an end of said second arm opposite said main body, comprising:

a second inner surface defining a second one of said one or more inner handle bearing surfaces;

a second one of said one or more protrusions disposed on said second inner handle bearing surface and defining a second inner bearing stop;

a second outer surface defining a second outer bearing surface; and at least one second outer stop disposed on said second outer bearing surface.

R. The razor system of paragraph Q, wherein said first and second arms are integral with said main body and movable relative to one another to allow said razor cartridge to be releasably coupled to said handle.

S. The razor system of paragraphs Q or R, wherein said razor handle further comprises a spring-biased member located between said first and second arms, said spring-biased member engaging said razor cartridge to urge said razor cartridge to a home position.

T. The razor system of any of paragraphs L-S, wherein said one or more protrusions are disposed in a middle portion of said one or more inner handle bearing surfaces.

U. The razor system of any of paragraphs L-T, wherein said one or more protrusions comprise a curved surface, a perpendicular substantially planar surface, a sloped substantially planar surface, or any combination thereof.

V. A razor handle comprising:

a main body; and a head at one end of said main body, said head comprising one or more shell bearings having one or more inner bearing surfaces with one or more protrusions disposed thereon.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor handle comprising:

a main body; and a head at one end of said main body, said head comprising a shell bearing comprising:

an inner surface defining an inner bearing portion for pivotally engaging with a razor cartridge;

an outer surface defining an outer bearing portion;

at least one outer stop disposed on said outer bearing portion; and at least one inner bearing stop disposed on said inner bearing portion, wherein said at least one inner bearing stop is formed on and extends outward from said inner bearing portion.

2. The razor handle of claim 1, wherein said shell bearing is a first shell bearing, said inner surface is a first inner surface, said inner bearing portion is a first inner bearing portion, said outer surface is a first outer surface, said outer bearing portion is a first outer bearing portion, said inner bearing stop comprises at least one first inner bearing stop disposed on said first inner bearing portion, and said at least one outer stop comprises at least one first outer stop disposed on said first outer bearing portion, and wherein said head further comprises a second shell bearing, said second shell bearing comprising:

a second inner surface defining a second inner bearing portion for pivotally engaging with said razor cartridge;

a second outer surface defining a second outer bearing portion;

at least one second inner bearing stop disposed on said second inner bearing portion, wherein said second inner bearing stop is formed on and extends outward from said second inner bearing portion; and at least one second outer stop disposed on said second outer bearing portion.

3. The razor handle of claim 1, wherein said at least one inner bearing stop is configured to limit pivotal movement of said razor cartridge with respect to said head.

4. The razor handle of claim 1, wherein said at least one inner bearing stop is configured to limit pivotal movement of said razor cartridge, in at least one direction, with respect to said head.

5. The razor handle of claim 1, wherein said at least one inner bearing stop is disposed in a middle portion of said inner bearing portion and said at least one outer stop comprises a pair of outer stops disposed at opposing ends of said outer bearing portion.

6. The razor handle of claim 1, wherein said at least one inner bearing stop is disposed in a middle portion of said inner bearing portion.

7. The razor handle of claim 1, wherein said at least one inner bearing stop comprises a curved surface, a substantially planar surface, a sloped substantially planar surface, or any combination thereof.

8. The razor handle of claim 1, wherein said at least one inner bearing stop comprises a height of about 1 mm, a length of about 1 mm, and a width of about 1.5 mm.

9. The razor handle of claim 1, wherein said at least one inner bearing stop comprises at least two inner bearing stops that are offset from each other.

10. A razor system comprising:

a razor handle comprising a main body and a head at one end of said main body, said head comprising a shell bearing comprising an inner surface defining an inner handle bearing portion, at least one inner bearing stop disposed on said inner handle bearing portion, an outer surface defining an outer handle bearing portion, and at least one outer stop disposed on said outer handle bearing portion; and a razor cartridge pivotally coupled to said razor handle via said shell bearing, said razor cartridge engaging said at least one inner bearing stop disposed on said inner handle bearing portion and said at least one outer stop to limit pivotal movement of said razor cartridge with respect to said head, wherein said at least one inner bearing stop is formed on and extends outward from said inner handle bearing portion.

11. The razor system of claim 10, wherein said shell bearing is a first shell bearing, said inner surface is a first inner surface, said inner handle bearing portion is a first inner handle bearing portion, said outer surface is a first outer surface, said outer handle bearing portion is a first outer handle bearing portion, said inner bearing stop comprises at least one first inner bearing stop disposed on said first inner handle bearing portion, and said at least one outer stop comprises at least one first outer stop disposed on said outer handle bearing portion, and wherein:

said head further comprises a second shell bearing and first and second arms extending from said main body;

said first shell bearing is coupled to an end of said first arm opposite said main body;

said second shell bearing is coupled to an end of said second arm opposite said main body;

said razor cartridge is further pivotally coupled to said razor handle via said second shell bearing; and said second shell bearing comprises:

a second inner surface defining a second inner handle bearing portion;

a second outer surface defining a second outer handle bearing portion;

at least one second inner bearing stop disposed on said second inner handle bearing portion; and at least one second outer stop disposed on said second outer handle bearing portion.

12. The razor system of claim 11, wherein said first and second arms are integral with said main body and movable relative to one another to allow said razor cartridge to be releasably coupled to said head.

13. The razor system of claim 11, wherein said head further comprises a spring-biased member located between said first and second arms, said spring-biased member engaging said razor cartridge to urge said razor cartridge to a home position.

14. The razor system of claim 10, wherein said razor cartridge comprises a housing, said housing comprising inner cartridge bearing surface that is received in said inner handle bearing portion.

15. The razor system of claim 14, wherein said at least one inner cartridge bearing surface further comprises at least one handle engaging portion that engages said at least one inner bearing stop.

16. The razor system of claim 14, wherein said at least one inner cartridge bearing surface comprises a projection that engages said at least one inner bearing stop disposed on said inner handle bearing portion, and wherein said housing comprises at least one extension that is received in said outer handle bearing portion and engages said at least one outer stop, said at least one extension cooperating with said projection to further limit said pivotal movement of said razor cartridge with respect to said head.

17. The razor system of claim 10, wherein said at least one inner bearing stop is disposed in a middle portion of said inner handle bearing portion.

18. The razor system of claim 10, wherein said at least one inner bearing stop comprises a curved surface, a substantially planar surface, a sloped substantially planar surface, or any combination thereof.

* * * * *